United States Patent [19]

Inagaki et al.

[11] Patent Number: 4,616,984

[45] Date of Patent: Oct. 14, 1986

[54] SLIDING-VANE ROTARY COMPRESSOR WITH SPECIFIC CYLINDER BORE PROFILE

[75] Inventors: Mitsuo Inagaki, Okazaki; Kenji Takeda, Nukata; Shigeki Iwanami; Hideaki Sasaya, both of Okazaki; Eiichi Nagasaku, Chiryu, all of Japan

[73] Assignees: Nippondenso Co., Ltd., Kariya; Nippon Soken, Inc., Nishio, both of Japan

[21] Appl. No.: 711,839

[22] Filed: Mar. 14, 1985

[30] Foreign Application Priority Data

Mar. 14, 1984 [JP] Japan ..... 59-47178

[51] Int. Cl.[4] ..... F04C 18/00

[52] U.S. Cl. ..... 418/150; 418/255; 418/259

[58] Field of Search ..... 418/150, 255, 259

[56] References Cited

U.S. PATENT DOCUMENTS

| | | | |
|---|---|---|---|
| 2,791,185 | 5/1957 | Bohnhoff et al. | 418/150 |
| 3,565,558 | 2/1971 | Tobacman | 418/150 |
| 4,480,973 | 11/1984 | Ishizuka | 418/150 |
| 4,501,537 | 2/1985 | Ishizuka | 418/150 |

FOREIGN PATENT DOCUMENTS

| | | |
|---|---|---|
| 58-70086 | 4/1983 | Japan . |
| 58-106580 | 7/1983 | Japan . |

*Primary Examiner*—John J. Vrablik

*Attorney, Agent, or Firm*—Cushman, Darby & Cushman

[57] ABSTRACT

A multiple-vane rotary compressor having a cylinder bore profile especially designed to reduce the fluctuation in the overall drive torque applied to the rotor shaft. The cylinder bore profile is configured and designed so that the individual drive torque applied to an individual vane during the compression and delivery strokes varies along a drive torque-vane angle curve which approximates an isosceles triangle having a lower side corresponding to a range of angle of 180°. The cylinder bore profile includes, for a profile section extending through an angle of 180°, a first region (i) in which the amount of vane projection is held substantially constant at a maximum value (D), a second region (ii) in which the amount of vane projection decreases at a higher rate, and a third region (iii) in which the amount of vane projection decreases to zero at a lower rate, the imaginary transitional point ($A_3$) between the second and third regions being located at an angular position of 90°.

5 Claims, 13 Drawing Figures

SLIDING-VANE ROTARY COMPRESSOR WITH SPECIFIC CYLINDER BORE PROFILE

BACKGROUND OF THE INVENTION (1) Field of the Invention

The present invention relates to a vane-type rotary compressor. More particularly, the present invention relates to an improved vane-type rotary compressor having a cylinder bore profile specifically designed to reduce fluctuation of overall drive torque usually resulting during operation of a rotary compressor. The rotary compressor according to the invention may be suitably used in an air-conditioning system of an automobile for pumping a refrigerant circulated in the system.

(2) Description of the Related Art

Typically, a vane-type rotary compressor includes a pump cylinder having a substantially cylindrical bore defining a pumping chamber. A pump rotor driven by a rotor shaft is rotatably received within the cylinder bore and is offset from the central axis of the bore in such a manner that the outer periphery of the rotor inscribes the inner wall of the cylinder bore. The rotor is provided with a plurality of angularly spaced, substantially radial vane slots in which a plurality of movable vanes are slidably fit, with their sealing edges in a close sliding contact with the inner wall of the cylinder bore. The pumping chamber is divided by the slidable vanes into a plurality of variable volume working chambers, each defined between two consecutive vanes. Due to the offset arrangement of the rotor, each vane projects from and retracts within the rotor as the rotor is rotated, so that the volumes of the respective working chambers are cyclically varied between the minimum and maximum values, thereby performing in sequence intake, compression, and delivery strokes of the compressor.

The torque required to rotationally drive any particular single vane is primarily dependent on the differential pressure developed between the leading and trailing sides of that vane due to the high pressure fluid in the preceding working chamber located at the leading side of the vane and the low pressure fluid in the successive working chamber located at the trailing side of the same vane. More specifically, the torque for a particular vane is determined by the product of the differential pressure multiplied by the surface area of the portion of the vane projecting from the rotor and by the distance of that portion measured from the central axis of the rotor.

When the vane is moving on an intake stroke, in other words, when the working chamber located at the leading side of the vane is under suction pressure, the vane undergoes substantially no differential pressure so that the drive torque required to rotate the vane is negligible. When the vane is moving on the compression stroke, the differential pressure increases but the amount of projection of the vane from the outer periphery of the rotor decreases. When the vane is moving on the delivery stroke, the differential pressure and the amount of vane projection both decrease. In an ordinary vane-type rotary compressor, the drive torque required to move an individual vane sharply increases and peaks at about the end of the compression stroke and suddenly drops thereafter. This causes the overall drive torque to fluctuate, thereby giving rise to vibrations and noise during the compressor operation. Such vibrations and noise are particularly disadvantageous when the compressor is mounted on an automobile as a pump for a refrigeration system. In one complete revolution of the rotor shaft, there are as many fluctuations in the drive torque as the number of slidable vanes and as the compression strokes performed in one revolution.

One solution to the problem of drive torque fluctuation has been proposed in Japanese Unexamined Utility Model Publication (Kokai) No. 58-106580, published July 20, 1983. In FIG. 3 of that publication, there is disclosed a rotary vane compressor having a triangular pump cylinder. The cylinder 11 is provided with three independent pumping chamber 19 each adapted to cooperate with four slidable vane 18. During one revolution of the rotor 12, each of the four vanes undergoes drive torque variations as shown in the lower part of the graph of FIG. 4 so that the resultant torque or overall torque required to drive the compressor is relatively flattened as shown by the curve A. However, this arrangement has the disadvantage that it requires a plurality of delivery ports and delivery valves, thus the increasing number of parts and members.

Japanese Unexamined Patent Publication No. 58-70086 proposes to solve the problem of torque fluctuation in a different way. This proposal is based on the principle that, in order to reduce torque fluctuation, the profile of cylinder bore must be determined in such a manner that for each vane moving on the compression stroke, the amount of vane projection decreases as a function of the pressure increase. Toward this end, as shown in the graph of FIG. 4 of that publication illustrating the amount of vane projection in terms of the angle of rotation, the cylinder profile is composed of, for each section forming one complete cycle of intake, compression, and delivery strokes, a circular sealing section $Q_0$–$Q_1$ in which the rotor contacts the cylinder inner wall, a curved region $Q_1$–$Q_2$ in which the vane is projected with an increasing projection speed, a curved region $Q_2$–$Q_3$ in which the projection speed of the vane is decreased, a circular region $Q_3$–$Q_4$ in which the amount of projection is kept constant, a curved region $Q_4$–$Q_5$ in which the vane is retracted with an increasing retraction speed, a curved region $Q_5$–$Q_6$ in which the retraction speed is decreased, a circular region $Q_6$–$Q_7$ in which the amount of vane projection is held constant, a curved region $Q_7$–$Q_8$ in which the vane is further retracted with an increasing retraction speed, and a curved region $Q_8$–$Q_9$ in which the retraction speed is decreased. The disadvantage of this solution is that the followability of the vane (i.e., the ability of the vane to follow the inner circumference of the cylinder bore) becomes poor because the vane must be projected with a considerable rate of acceleration.

SUMMARY OF THE INVENTION

The object of the present invention is to provide a vane-type rotary compressor capable of operating with a reduced torque fluctuation and having an improved followability of the vane. Another object is to provide a vane-type rotary compressor consisting of a reduced number of components and which is simple in construction and easy to manufacture.

The present invention is based on the discovery that, the overall torque required to rotate the rotor shaft being the sum of individual torques applied to individual vanes, the fluctuation in the overall torque can be avoided or at least reduced by properly designing the cylinder bore profile in such a manner that, although the individual torques for individual vanes considerably fluctuate, the overall torque resulting from combination of the individual torques is kept substantially constant. According to the present invention, this is achieved by designing the cylinder bore profile such that the individual torque applied to an individual vane during each cycle of compression and delivery strokes of the vane varies along a torque curve which approximates an isosceles triangle having a lower side corresponding to a range of rotational angle of 180°. The torque curve may be defined as a curve showing the relationship between the torque and angular position.

With such a cylinder bore profile, the overall torque required to be applied to the rotor shaft for any angular position of the rotor will be approximately equal to the sum of individual torques applied to two consecutive vanes which are moving on the compression and delivery strokes with a phase difference of 90° therebetween. Since the individual torque of each of these two vanes is accommodated to vary along a torque curve approximating an isosceles triangle with a lower side spanning a range of angles of 180° and because a rectilinear line is obtained by composing two isosceles triangles offset from each other with a phase difference of 90°, the overall torque resulting from the sum of the two individual torques will be substantially constant.

In a preferred embodiment, the cylinder bore profile comprises three regions for a profile section located between a point on said profile at which the vane angle is equal to zero and a point at which the vane angle is equal to 180°, the vane angle being measured in the direction of rotation of the rotor with respect to the angular position of the vane at which the amount of projection of the vane from the rotor reaches a maximum value. The first region is the one in which the amount of vane projection is held substantially constantly at the maximum value. The second region is the one in which the amount of vane projection decreases substantially at a relatively large first rate. The third region is the one in which the amount of vane projection decreases to zero at a second rate smaller than the first rate. The transitional point between the second and third regions is positioned substantially at an angular position of 90°.

With this arrangement, the drive torque applied to a vane increases substantially linearly as a result of the increasing fluid pressure in the working chamber when the vane is moving along the first and second region. The torque then reaches a maximum value when the vane is brought to the transitional point between the second and third regions. As the vane slides along the third region, the torque decreases substantially linearly in response to the decreasing amount of vane projection. In this manner, the torque curve dictated by each vane approaches an isosceles triangle so that the overall torque fluctuation is substantially eliminated.

In order that the torque-angle curve described by each vane closely approximate an isosceles triangle, it is required that the individual torque become zero at the vane angle of zero, peak at the vane angle of 90°, and fall to zero at the vane angle of 180°. Therefore, according to another preferred embodiment of the invention having a compression ratio of 6 and adapted for pumping R-12 refrigerant normally used in car air-conditioning systems, the first, second, and third regions of the cylinder bore profile are selected to extend, respectively, through an angle of 45°, 45°, and 90° and the amount of vane projection at the transitional point between the second and third regions is selected to be about 40% of the maximum value.

If the cylinder bore profile presents any discontinuities at transitional points between the aforementioned regions or other regions, the sealing edges of vanes will strike the inner wall of the cylinder bore, thereby producing noise and vibration. Thus, according to a preferred embodiment, the cylinder bore profile follows a smooth continuous curve expressed by the equation $$d(\theta)=D'2\{\cos\theta+k_1\cdot\cos 3(\theta+\psi)\}+D/2$$

where $d(\theta)$ is the amount of vane projection at a vane angle $\theta$, D is the maximum amount of vane projection, $k_1$ is a constant greater than 0.1 and less than 0.25, $\psi$ is a constant greater than $-35°$ and less than $-20°$, and D' is a value satisfying the relationship $d(\theta)=D$ at an angular position at which $d(\theta)$ reaches the maximum value.

These and other features of the invention will be described hereinafter in detail with reference to the accompanying drawings.

DESCRIPTION OF THE PREFERRED EMBODIMENTS

(1) Overall Construction

Figure 1:
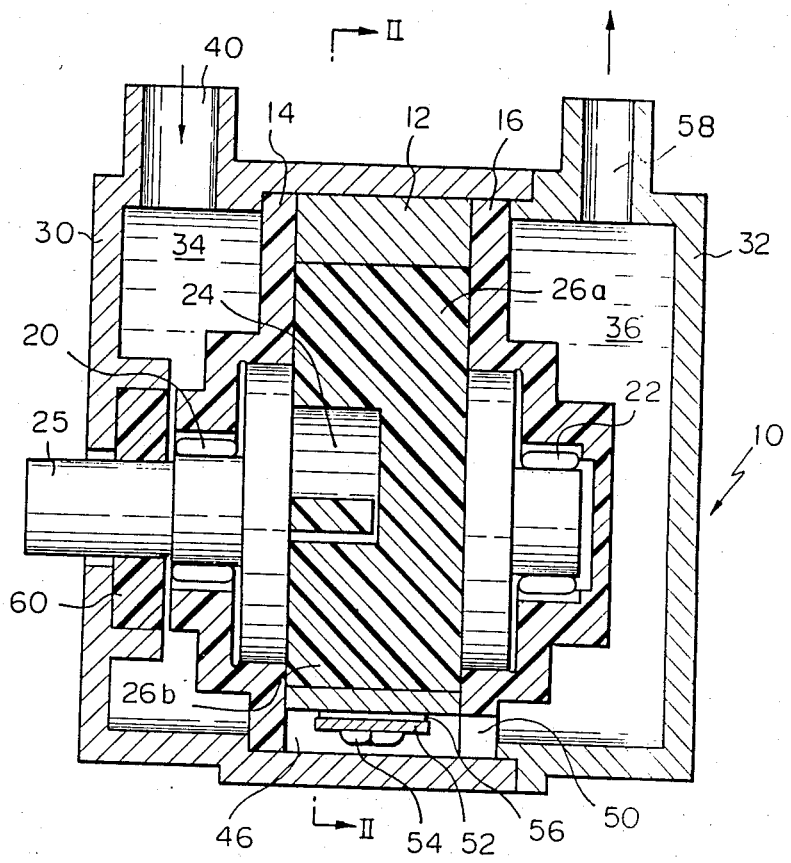
FIG. 1 is a cross-sectional view taken along the line I—I of FIG. 2 and showing the vane-type rotary compressor according to the invention.
Figure 2:
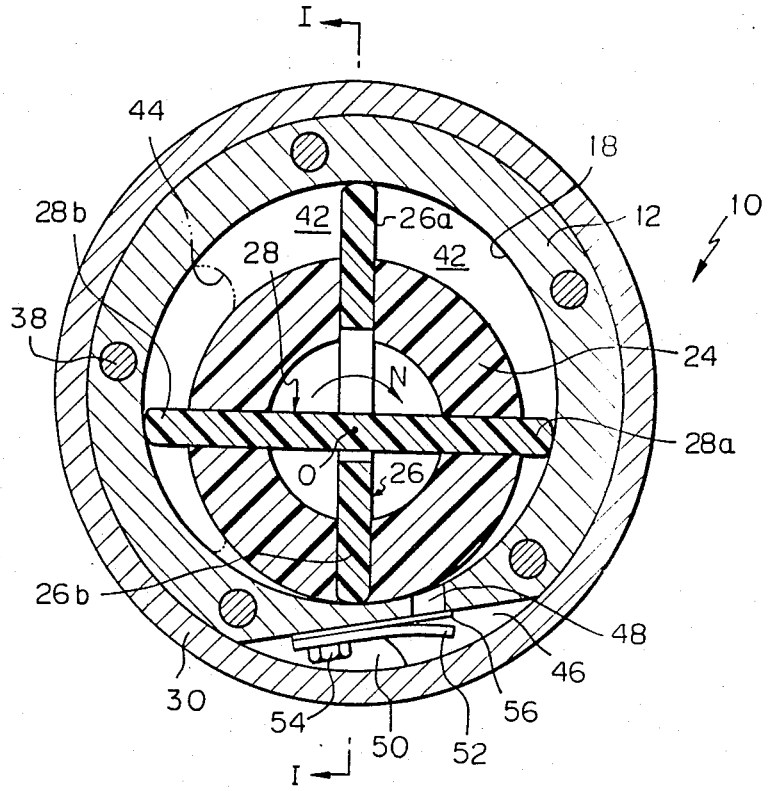
FIG. 2 is a cross-sectional view taken along the line II—II of FIG. 1.

FIGS. 1 and 2 schematically show the overall construction of a vane-type rotary compressor according to the invention. A compressor 10 includes a split housing 30, 32 receiving a pump cylinder 12, a front end plate 14 and a rear end plate 16. The cylinder 12 is provided with a cylinder bore 18 having a profile as described hereinafter in detail with reference to FIGS. 3 through 6. A rotor shaft 25 made integral with a rotor 24 is journaled on the front and rear end plates 14 and 16 by antifriction bearings such as needle bearings 20 and 22. The rotor shaft 25 is adapted to be rotated by a pulley (not shown) keyed thereto and driven, for example, by an automobile engine. As best shown in FIG. 2, the central axis O of the rotor 24 is offset downward with respect to the central axis of the cylinder 12 in such a manner that the outer periphery of the rotor 24 inscribes the cylinder bore 18 with a small clearance.

In the embodiment illustrated in FIGS. 1 and 2, the rotor 24 is hollow and is provided with two through slots extending diametrically therethrough to pass the central axis O. These through slots, serving as vane slots, intersect at a right angle with each other and extend throughout the entire axial length of the rotor 24. A pair of vane assemblies 26 and 28 extending perpendicularly with each other are closely and slidably fit in the vane slots. The vane assemblies 26 and 28 are identical in shape and size with each other and include, respectively, a pair of vane sections **26*a* and 26*b*; 28*a* and 28*b* integrally connected with each other at an intermediate portion of the assemblies. As shown in FIG. 1, the intermediate portion of each vane assembly is cut out by a half of its axial width to permit the two assemblies to pass through each other in a staggered manner to ensure relative movement. The rotary vane compressor of this construction is referred to as a "through-vane" type in the sense that the vane assemblies extend through the rotor. The "through-vane" compressor 10 may be considered as having in total four vanes 26*a*, 26*b*, 28*a*, and 28*b*, although actually it includes only two vane assemblies 26 and 28. In the specification and the appended claims, the vane-type rotary compressor will occasionally be described as having four independent vanes, but in the case of the "through-vane" compressor the term "vanes" is intended to designate these vane sections 26*a*, 26*b*, 28*a*, and 28*b* formed by vane assemblies 26 and 28. However, it should be noted that the present invention is not limited to the through-vane type compressor but is also directed to those compressors having independent vanes received in respective non-through vane slots. In the through-vane type compressor, the profile of the cylinder bore 18** is so shaped that all the outer sealing edges of the vanes are simultaneously in contact with the inner wall of the cylinder bore for all angular positions of the vanes.

The split housing or outer shell of the compressor includes a front housing part 30 and a rear housing part 32. The front housing part 30, front end plate 14, cylinder 12, rear end plate 16, and rear housing part 32 are fastened together by through-bolts 38. A suction or intake chamber 34 is defined between the front housing part 30 and the front end plate 14, while a delivery chamber 36 is defined between the rear end plate 16 and the rear housing part 32. As shown in FIG. 1 the front housing part 30 has an inlet 40 communicated with the suction chamber 34. As shown in FIG. 2, the front end plate 14 is provided with an arcuated suction port 44 communicating the suction chamber 34 to the pumping chamber 42. The pumping chamber 42 is divided by the slidable vanes **26*a*, 26*b*, 28*a*, and 28*b* into four variable volume working chambers. As shown in FIG. 2, the lower part of the cylinder 12 is recessed to form a valve chamber 46 between the cylinder 12 and the housing part 30. The pumping chamber 42 is communicated with the valve chamber 46 through a delivery port 48 in the cylinder 12. The valve chamber 46 is, in turn, communicated with the delivery chamber 36 through a passage 50 in the rear end plate 16. The delivery port 48 is opened and closed by a valve plate 56 backed up by a valve stop 52 which is secured to the cylinder 12 by a screw 54. The rear housing part 32 is provided with an outlet 58. The rotor shaft 25 is sealed against the front housing part 30 by a conventional seal mechanism 60. The overall construction of the compressor 10** described above is substantially the same as that of the conventional through-vane compressor, except for the cylinder profile described later.

As the rotor 24 is rotated in the direction of the arrow N under the drive force of an engine (not shown), respective vanes are turned in the same direction with their sealing edges sliding along the inner wall of the cylinder bore 18. Each working chamber defined by the outer periphery of the rotor 24, the inner wall of the cylinder bore 18, the inner walls of the front and rear end plates 14 and 16, and a pair of consecutive vanes, cyclically changes in volume so that a gaseous refrigerant is drawn from an evaporator (not shown) of a car air-conditioning system through the inlet 40, suction chamber 34, and suction port 44 into the working chamber and is pressurized therein and discharged through the delivery port 48, valve chamber 46, passage 50, delivery chamber 36, and outlet 58 toward a condensor (not shown) of the air-conditioning system.

(2) Cylinder Bore Profile

Figure 3:
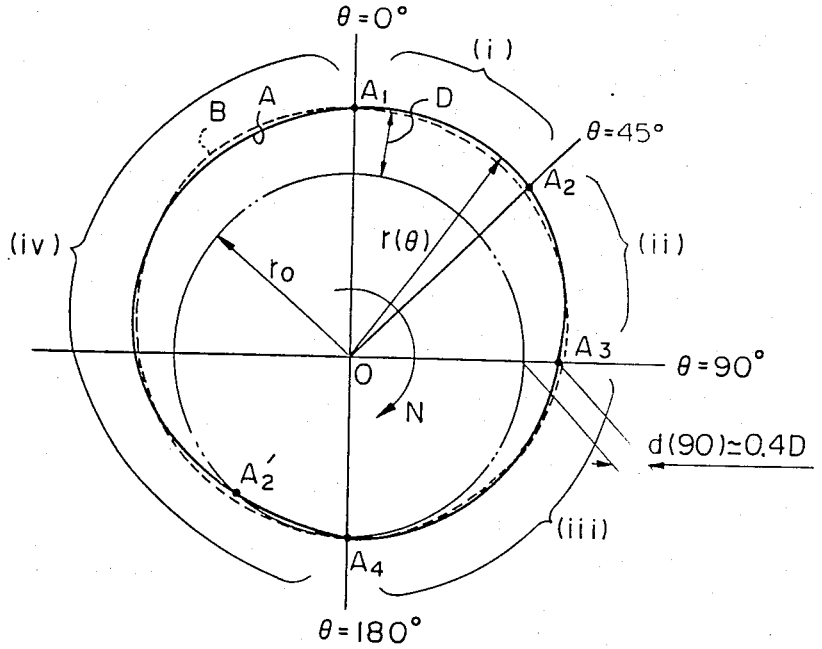
FIG. 3 is a diagram showing by the solid line the cylinder bore profile according to the invention, the conventional bore profile being shown by the broken line.

The cylinder bore profile according to the first embodiment of the invention will be described with reference to FIG. 3. In FIG. 3, the profile according to the invention is shown by the solid line A whereas the profile of the conventional through-vane compressor is shown by the broken line B. The conventional bore profile B is given by the equation (1)

$$d(\theta)=D/2(1+\cos\theta) \quad (1)$$

where $d(\theta)$ is the amount of projection of a vane at a vane angle of $\theta$ measured with respect to the angular position of the vane at which the amount of vane projection reaches a maximum value D. Equation (1) is determined to ensure that the sealing edges formed at the opposite ends of a through-vane assembly are simultaneously brought into contact with the inner wall of the cylinder bore for all vane angles as well as to ensure that the vane projects from and retracts within the rotor with smooth changes in the sliding movement to ensure that the change in the movement of the vane as they slide along the vane slots to project from and retract within the rotor takes place in a smooth manner.

In contrast, the cylinder bore profile A according to the invention comprises a region (i) in which the amount of vane projection is held substantially at the maximum value D and which extends from an imaginary point $A_1$ at which the vane angle is zero ($\theta=0$) to an imaginary point $A_2$ at which the vane angle is 45° ($\theta=45°$), a region (ii) in which the amount of vane projection decreases at a higher rate and which extends between the point $A_2$ and a point $A_3$ at which the vane angle is 90° ($\theta=90°$) and at which the amount of vane projection D' is roughly equal to 40% of the maximum value D, a region (iii) in which the amount of vane projection decreases at a lower rate and which extends from the point $A_3$ ($\theta=90°$) to a point $A_4$ at which the amount of vane projection becomes zero and which is located at the vane angle of 180°, and a region (iv) which is shaped complementarily to the regions (i), (ii), and (iii) with respect to the center O of rotation of the rotor. All these four regions (i) through (iv) are connected together to form a smooth continuous profile.

More specifically, the cylinder bore profile A shown in FIG. 3 has a moving radius $r(\theta)$, as measured from the center O of the rotor to the cylinder bore at a vane angle of $\theta$, expressed by equation (2)

$$r(\theta)=0.452D\{\cos\theta+0.175\cdot\cos 3(\theta-27.5°)\}+D/2+r_0 \quad (2)$$

where $r_0$ is the radius of the rotor.

(3) Fundamental Theory for Reducing Torque Fluctuation

Generally, the overall drive torque of a vane-type rotary compressor is dependent on the torque applied to the rotor shaft during the compression and delivery strokes. The mean value $\overline{T}$(kgf−m) of the overall drive torque may be calculated, with the suction pressure $P_s$(kgf/m²abs), the delivery pressure $P_d$(kgf/m²abs), and the intake volume $V_s$(m³/rev) per revolution of the compressor, as follows.

$$\overline{T}=\frac{V_sP_s}{2\pi}\cdot\frac{k}{k-1}\left\{\left(\frac{P_d}{P_s}\right)^{\frac{k-1}{k}}-1\right\} \quad (3)$$

where k is the adiabatic exponent and is equal to 1.14 for the R-12 refrigerant which is normally used in a car air-conditioning system. The individual drive torque $t(\theta)$ applied to each vane may be calculated by the differential pressure $\Delta P(\theta)$ developed between the leading and trailing sides of the vane, the amount of vane projection $d(\theta)$, the axial length l of the working chamber, and the radius $r_0$ of the rotor. The individual torque $t(\theta)$ for a vane angle of $\theta$ is given by equation (4).

$$t(\theta)=l\cdot\Delta P(\theta)\cdot d(\theta)(r_0+d(\theta)/2) \quad (4)$$

This invention is based on the finding that, by properly determining the cylinder bore profile, the individual torque-vane angle characteristics must be modified in such a manner that the sum of two individual torques $t(\theta)$ and $t(\theta-90°)$ applied to two consecutive vanes moving with a phase difference of 90° becomes constant thereby reducing the fluctuation in the overall drive torque T.

Figure 4:
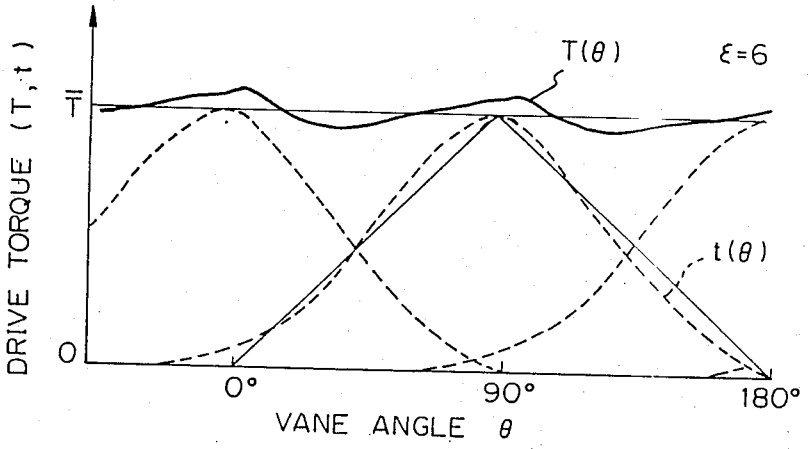
FIG. 4 is a graph illustrating the principle underlying the present invention and showing the relationship between the torque and the angular position of the vane, with the isosceles triangle showing the fundamental torque variation of an individual vane, the fine straight line showing the composite torque resulting from the sum of two triangles, the broken lines showing the theoretical torque curve obtained by the theoretical bore profile, and the thick solid curve representing the overall torque curve composed of two theoretical individual torque curves.

Toward this end, the present invention proposes to design the cylinder bore profile such that, as shown in FIG. 4, the torque curve of individual torque $t(\theta)$ approaches an isosceles triangle, the lower side of which spans over an angle range of 180° and the apex of which is located at the level of the mean value $\overline{T}$ of the overall drive torque of the compressor, so that the torque curve of the overall torque T, composed of an individual torque curve of a given vane and of another individual torque curve of an adjacent vane moving with a phase difference of 90°, is substantially flattened.

(4) Design of Theoretical Profile

Figure 5:
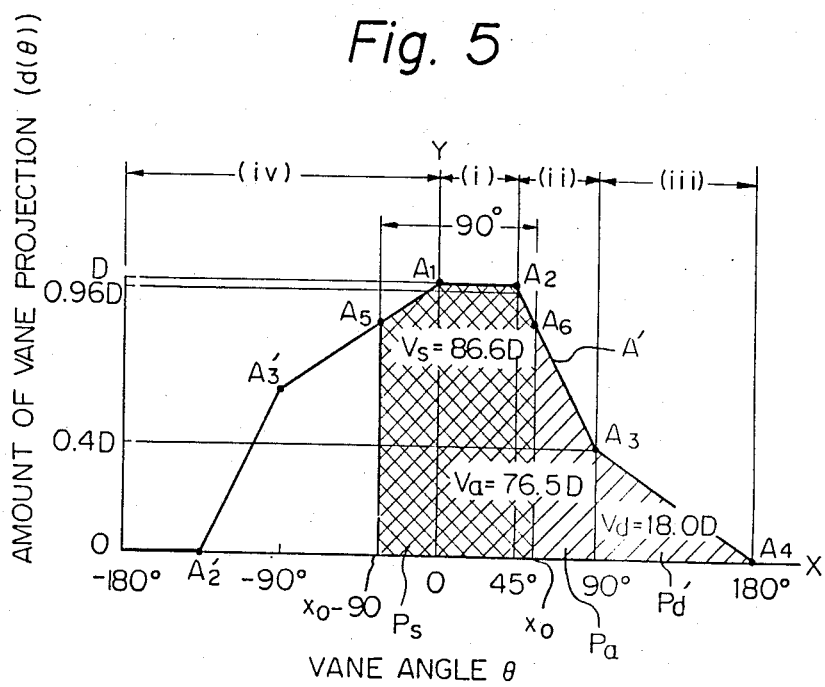
FIG. 5 is a graph showing the theoretical cylinder bore profile according to the invention plotted on an orthogonal coordinate system, with the ordinate Y showing the amount of vane projection and the abscissa X showing the angular position of the vane.

The design theory of a cylinder bore profile underlying the present invention will be described with reference to the graph of FIG. 5 showing the theoretical profile plotted on an orthogonal coordinate system. In the graph of FIG. 5, the abscissa X indicates the vane angle $\theta$ as measured with respect to the reference point $A_1$ shown in FIG. 3, the ordinate Y represents the amount of vane projection $d(\theta)$ which is measured from the outer periphery of the rotor and in equal to the moving radius $r(\theta)$ minus the rotor radius $r_0$. In the graph, the point $A_1$ at which the amount of vane projection $d(\theta)$ reaches its maximum value D is positioned at the vane angle of $\theta=0$, and the point $A_4$ at which the amount of vane projection $d(\theta)$ becomes zero is located at the vane angle of $\theta=180°$.

(4-1) Outline of Theoretical Profile

In the theoretical cylinder bore profile A' shown in FIG. 5, the first region (i) extends between the point $A_1$ and a point $A_2$. This region (i) is defined as a region in which the amount of vane projection $d(\theta)$ is kept at its maximum value D. The second region (ii) is defined as a region in which the amount of vane projection $d(\theta)$ decreases at a high rate. The second region (ii) extends from the point $A_2$ to a point $A_3$ which is located at the vane angle of $\theta=90°$. The third region (iii) extends through an angle of 90° and is deliniated between the points $A_3$ and $A_4$. In the third region (iii), the amount of vane projection $d(\theta)$ decreases to zero at a lower rate. The fourth region (iv) is defined between the points $A_4$ and $A_1$. In a through-vane type rotary compressor, the amount of vane projection $d(\theta)$ at any point on the fourth region (iv) is complementary to the amount of vane projection at a point having a phase difference of 180° and located on either of the regions (i), (ii), and (iii). That is, in the fourth region (iv), the amount of vane projection $d(\theta)$ is determined so that the sum of the value $d(\theta)$ and the amount of vane projection at the complementary point located on the first, second, or third region is equal to the maximum amount D.

(4-2) Determination of the Maximum Torque Point ($A_3$)

Generally, in a vane-type rotary compressor, the amount of vane projection $d(\theta)$ decreases during the compression and delivery strokes. This causes the volume v of a working chamber, which is defined by two consecutive vanes, the inner wall of the cylinder bore, and the outer periphery of the rotor, to decrease from the maximum volume $v_s$ to zero. The pressure P applied to a particular vane from the working chamber located at the leading side of the vane increases rapidly in response to the decrease in the volume v of the working chamber. This pressure P is calculated by the equation $P=P_s(v_s/v)^{1.14}$, where P is the suction pressure. When the pressure P reaches the delivery pressure $P_d$, the delivery valve 56 is opened so that the pressure is thereafter kept constant at the delivery pressure $P_d$. Since the rate of pressure increase in a working chamber is higher than the rate at which the amount of vane projection $d(\theta)$ decreases, the individual drive torque t applied to each vane presents a peak value when the working chamber pressure P reaches the delivery pressure $P_d$.

Thus, in order to ensure that the individual drive torque applied to an individual vane varies along the isosceles triangle as shown in FIG. 4, it is at first necessary that the individual drive torque at the point $A_3(\theta=90°)$ be located at the apex of the isosceles triangle. Toward this end, the pressure P must reach the delivery pressure $P_d$ at the point $A_3$.

(4-3) Determination of Region (i)

The second requisite necessary to ensure that the curve of the individual torque-vane angle characteristics closely approaches the isosceles triangle of FIG. 4 is that the drive torque t(0°) at the vane angle of $\theta=0°$ reaches zero as close as possible. Toward this end, according to the invention, the first region (i) located between the points $A_1$ and $A_2$ and in which the amount of vane projection is held at its maximum value D is selected to extend through a range of angle of 45°. With this arrangement, the point at which the individual drive torque commences to rise substantially approaches the vane angle $\theta=0$. This is due to the fact that, before the vane reaches the maximum projection region (i), the differential pressure existing between the pressure in the working chamber located at the leading side of the vane and the pressure in the working chamber located at the trailing side is small enough because the change in the volume of the leading side working chamber, which change is proportional to the difference between the amounts of vane projection $d(\theta)$ of two consecutive vanes defining that working chamber, is very small.

(4-4) Determination of Amount of Vane Projection at Point $A_3$

Another requisite for the pressure P to reach the delivery pressure $P_d$ at the point $A_3$ is that the amount of vane projection $d(\theta)$ at the point $A_3$ satisfy the following conditions.

Condition 1: $\epsilon=(v_s/v_d)^{1.14}=6$

Condition 2: $\overline{T}=t(90°)$ where $\epsilon$ is the compression ratio $P_d/P_s$, $v_s$ is the maximum volume of the working chamber, $v_d$ is the volume of the working chamber formed between two vanes located at the points $A_3$ and $A_4$, respectively, $\overline{T}$ is the mean value of the overall drive torque of the compressor, and t(90°) is the individual torque applied to a vane located at the point $A_3$.

Condition 1 above is required for the delivery stroke to commence at the vane angle $\theta=90°$. The reason that the compression ratio $\epsilon=6$ is because it is thought most suitable in view of the operational conditions of the compressor as it is used in a car air-conditioning system. Condition 2 above is necessary for the maximum value of the individual torque to be equal to the value of the overall drive torque.

The amount of vane projection d(90°) at the point $A_3$ that meets the conditions 1 and 2 above is determined in the following manner.

In a four-vane compressor, the intake volume of a working chamber is equal to the volume trapped between two consecutive vanes moving with a phase difference of 90° with each other. This volume is proportional to the working chamber transversal cross-sectional area defined between two consecutive vanes. In the graph of FIG. 5, the transversal cross-sectional area is in turn generally proportional to the area of the cylinder bore profile sectioned by two Y axes spaced from each other at an angle of 90°. Since the surface area of the thus sectioned profile area presents its maximum value when the two Y axes pass through the points $A_5$ and $A_6$ having an equal Y coordinate, the maximum intake volume $v_s$ corresponds to the profile section shown in FIG. 5 by the cross-hatched area extending between the points $A_5$ and $A_6$.

Assuming the X-Y coordinates of the point $A_3$ at the vane angle of 90° to be (90, aD), then the coordinates of a point $A_3'$ at a vane angle of −90° would be (−90, (1−a)D), because in a through-vane type compressor, the sum of the amounts of vane projection of two vanes located at a phase difference of 180° is equal to the maximum amount D. Accordingly, the segment $\overline{A_3'A_1}$ can be expressed by the equation $$y_1 = \frac{aD}{90} x + D \tag{5}$$

Also, the segment $\overline{A_2A_3}$ may be expressed as follows.

$$y_2 = -\frac{(1-a)D}{45} x + (2-a)D \tag{6}$$

By locating the point $A_6$ at a vane angle $x_0$ on the segment $\overline{A_2A_3}$ expressed by equation (6) and by locating the point $A_5$ at a vane angle ($x_0$−90°) on the segment $\overline{A_3'A_1}$ expressed by equation (5), we get:

$$y_1x = x_0 - 90 = y_2x = x_0 \tag{7}$$

Therefore, $$\frac{aD}{90}(x_0 - 90) + D = -\frac{1-a}{45} Dx_0 + (2-a)D \tag{7'}$$

From equation (7′), $$x_0(2-a)D = 90D$$

Therefore, $$x_0 = \frac{90}{2-a} \tag{8}$$

Thus, the X coordinate of the point $A_6$ is obtained.

In FIG. 5, the surface area of the cross-hatched area reflecting the maximum intake volume $v_s$ is the sum of the surface area of the first trapezoid (0, $x_0$−90, $A_5$, $A_1$), the surface area of the rectangle (0, $A_1$, $A_2$, 45), and the surface area of the second trapezoid (45, $A_2$, $A_6$, $x_0$).

To calculate the surface area of the first trapezoid, the Y coordinate $y_a$ of the point $A_5$ must be first determined, as follows:

$$Y_a = \frac{aD}{90}\left(\frac{90}{2-a} - 90\right) + D = aD\frac{a-1}{2-a} + D = \frac{a^2-2a+2}{2-a} D$$

Thus, the surface area of the first trapezoid is given as follows.

$$\text{Surface area of the first trapezoid} = \left(\frac{a^2-2a+2}{2-a} D + D\right) \cdot (90 - x_0)/2 = \frac{a^2-3a+4}{2(2-a)}(90 - x_0)D$$

The surface area of the rectangle is given as follows.

Surface area of the rectangle=45·D

The surface area of the second trapezoid is calculated as follows.

$$\text{Surface area of the second trapezoid} = \left\{-\frac{(1-a)D}{45}\cdot\frac{90}{2-a} + (2-a)D + D\right\}(x_0 - 45)/2 = \frac{a^2-3a+4}{2(2-a)}(x_0 - 45)D$$

Accordingly, the surface area of the cross-hatched area corresponding to maximum intake volume $v_s$ is given as follows:

$$\begin{aligned} v_s &= (\text{surface area of the first trapezoid}) + (\text{surface area of the rectangle}) + (\text{surface area of the second trapezoid}) \\ &= \frac{a^2-3a+4}{2(2-a)} D\{(90 - x_0) + (x_0 - 45)\} + 45D \\ &= \frac{45D(a^2-5a+8)}{2(2-a)} \end{aligned} \tag{9}$$

The surface area of the triangle (90, $A_3$, $A_4$) corresponding to the volume of the working chamber defined between two vanes located respectively at points $A_3$ and $A_4$ is calculated as follows.

$$v_d = aD\cdot 90/2 = 45aD \tag{10}$$

Meanwhile, in the compressor according to the invention, in order to minimize the overall torque fluctuation when the compression ratio $\epsilon(=P_dP_s)$ is equal to 6, condition 1 above must be met. Thus, $$\epsilon = (v_s/v_d)^{1.14} = 6$$

By solving the value $v_s/v_d$ from the above equation, $$\log(v_s/v_d)^{1.14} = \log 6 \tag{11}$$

$$\log(v_s/v_d) = \frac{1}{1.14}\log 6$$

$$\log(v_s/v_d) = 0.682588\ldots$$

Therefore, $$v_s/v_d = 10^{0.682588\ldots} = 4.81491\ldots$$

To calculate the value $v_s/v_d$ from the above equations (9), (10), and (11), $$v_s/v_d = 4.81491\ldots \approx 4.815$$

$$= \frac{45D(a^2 - 5a + 8)}{2(2 - a)} / 45aD$$

Therefore, $$a = 0.39979\ldots \approx 0.4$$

From the foregoing, in order to ensure that the pressure P in the working chamber reaches the delivery pressure $P_d$ at the point $A_3$ and, hence, the individual drive torque t(90°) attains the maximum value at the point $A_3$, the amount of vane projection d(90°) at the point $A_3$ must be approximately equal to 0.4D. In other words, the cylinder bore profile must be designed so that the amount of vane projection at the point $A_3$ is about 40% of the maximum amount D.

(4-5) Determination of Region (ii)

In the region (ii) spanning from the point $A_2$ (the vane angle $\theta=45°$) to the point $A_3$ ($\theta=90°$), the amount of vane projection must be reduced from the maximum value D to the value d(90°)=0.4D. Thus, in this region (ii), the cylinder bore profile is configured in such a manner that the amount of vane projection decreases at a larger rate as shown in FIG. 5.

(4-6) Determination of Region (iii)

In the third region (iii) extending from the point $A_3(\theta=90°)$ to the point $A_4(\theta=180°)$, the cylinder bore profile is designed so that the amount of vane projection decreases to zero at a constant moderate rate as shown in FIG. 5. As a result, the individual drive torque applied per vane decreases in the third region (iii) substantially linearly from the maximum value to zero.

(4-7) Verification of Theoretical Profile

Described below is how the foregoing conditions 1 and 2 are met by selecting the amount of vane projection d(90°) at the point $A_3$ to be equal to 0.4D and by setting the $A_1$–$A_2$ region (i) for an angle of 45°.

The intake volume per each working chamber of the vane compressor having the bore profile shown in FIG. 5 can be regarded as being proportional to the surface area of the cross-hatched area $v_s$. To calculate the surface area of the area $v_s$ on assuming the width through an angle of 1° as a dimensionless unit 1, $v_s$=86.6D. When a particular vane reaches the point $A_3$, the volume $v_a$ of the working chamber located at the low pressure side of that vane would be $v_a$=76.5D and the volume $v_d$ of the working chamber located at the high pressure side of the vane would be $v_d$=18.0D. When the intake fluid having the volume of $v_s$ is compressed to the volume $v_d$, the pressure $P_d'$ in the high pressure side working chamber is given as follows.

$$P_d' = (86.6D/18D)^{1.14} \cdot P_s \approx 6 \cdot P_s$$

It will be noted that this coincides with the compression ratio $\epsilon=6$ and, therefore, condition 1 above that $\epsilon=(v_s/v_d)^{1.14}$ is satisfied.

Second, assuming that, in equation (4), $d(\theta) << r_0$, the individual torque t(90°) applied to the vane located at the point $A_3$ is given by the following equation:

$$t(90°) = l\Delta P(90°) \cdot d(90°) \cdot r_0 \quad (4)$$

Since the pressure ΔP(90°) is the differential pressure between the leading and trailing sides of the vane located at the point $A_3$, the pressure ΔP(90°) is given as follows from the relationship $P_a=(86.6D/76.5D)^{1.14} \cdot P_s = 1.15P_s$ and from the relationship $P_d' = 6P_s$:

$$\Delta P(90°) = (6 - 1.15)P_s = 4.85P_s$$

Therefore, $$t(90°) = 4.85P_s \cdot 0.4D \cdot 1 \cdot r_0 \quad (12)$$

$$= 1.94 \cdot P_s \cdot D \cdot 1 \cdot r_0$$

In the meantime, the mean value of the overall drive torque $\overline{T}$ is expressed by the following equation (3') obtained by transformation of equation (3).

$$\overline{T} = \frac{V_s P_s}{2\pi} \cdot \frac{1.14}{1.14 - 1}\left(6^{\frac{1.14-1}{1.14}} - 1\right) \quad (3')$$

where $V_s$ is the overall intake volume per one revolution of the rotor. The overall intake volume $V_s$ is given by the equation $$V_s = 2\pi r_0 \overline{D} l \quad (13)$$

where $\overline{D}$ represents the average amount of vane projection which, in turn, is calculated as follows.

$$\overline{D} = 86.6D/90 = 0.96D$$

The value $V_s$ is obtained by substituting the value 0.96D for $\overline{D}$ in equation (13). By substituting the thus obtained value $V_s$ for $V_s$ in equation (3') and since $$\frac{1.14}{1.14 - 1}\left(6^{\frac{1.14-1}{1.14}} - 1\right) = 2,$$

equation (3') is rewritten as follows:

$$\overline{T} = \frac{2\pi r_0 \cdot 0.96Dl \cdot P_s}{2\pi} \cdot 2 = 1.92P_s Dlr_0 \quad (14)$$

Thus, it will be appreciated that equation (14) is approximately equal to equation (12) so that condition 2 above that $\overline{T}$=t(90°) is also satisfied.

(4-8) Overall Drive Torque

In the vane compressor having the cylinder bore profile according to the invention, it is possible to reduce the overall torque fluctuation based on the fact that the individual drive torque is applied simultaneously to two consecutive vanes moving with a phase difference of 90°. In FIG. 4, the curve of the individual drive torque t(θ) applied to each vane and obtained by the theoretical bore profile A' of FIG. 5 is shown by the broken lines and the curve of the overall drive torque $T(\theta)$ composed of these individual torques is shown by the solid line, with both curves corresponding to the operational condition wherein the compression ratio $\epsilon=6$. From FIG. 4, it will be appreciated that the curve of the individual torque $t(\theta)$ closely approximates the isosceles triangle having its apex located at the level of the average overall torque $\overline{T}$ and having its lower side spanning over the angle of 180°. It will be noted that, therefore, the fluctuation in the overall drive torque $T(\theta)$ can be considerably reduced.

(5) Designing Practical Cylinder Bore Profile

The concept of the invention by which the overall torque fluctuation is flattened has been described hereinbefore with reference to the theoretical cylinder bore profile illustrated in the orthogonal coordinate system. However, in a practical vane compressor, the presence of any discontinuities in the cylinder bore profile, such as the points $A_1$, $A_2$, $A_3$, and $A_4$, would cause the vane to strike the cylinder inner wall at such discontinuities thereby resulting in undesirable vibrations and noise. To avoid this, it is therefore necessary to modify the theoretical bore profile A' to a smoothened continuous curve throughout the entire regions.

Figure 6:
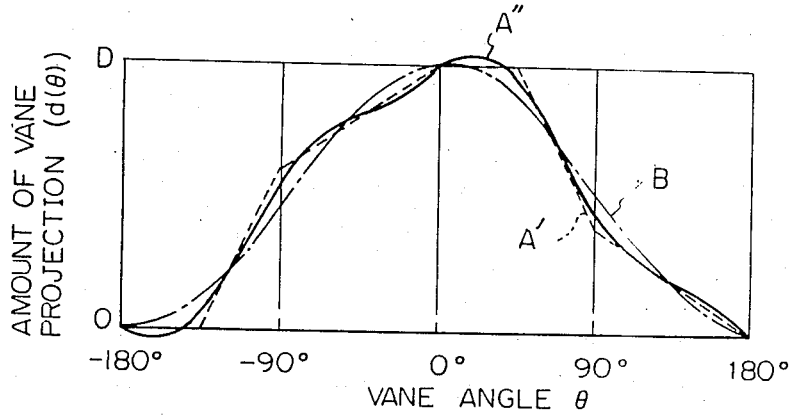
FIG. 6 is a graph similar to FIG. 5 but showing by the solid line the cylinder bore profile obtained by Fourier expansion of the theoretical profile shown by the broken line, with the chain line showing the conventional profile.

In the graph of FIG. 6, the preferred practical cylinder bore profile A'' according to the invention is shown by the solid line. The broken line A' indicates the theoretical profile shown in FIG. 5, and the chain line B indicates the conventional profile used in the conventional through-vane type compressor and expressed by the above-mentioned equation (1).

The practical profile A'' is obtained by Fourier expansion of the conventional profile B expressed by equation (1).

The profile A'' is composed of first and third components of the wave expressed by equation (1).

By comparing the curve A'' with the theoretical profile A', it will be noted that it is sufficient to design the practical profile A'' by composing the first and third components, in order to obtain a smooth continuous cylinder bore profile approximating the theoretical profile A' shown by the broken line.

Therefore, the amount of vane projection $d(\theta)$ may be expressed by the following general equation:

$$d(\theta) = \frac{D'}{2}\{\cos\theta + k_1 \cdot \cos 3(\theta + \psi)\} + \frac{D}{2} \qquad (15)$$

where D is the maximum amount of vane projection, $k_1$ is the ratio of the amplitude of the third component with respect to the amplitude of the first component, $\psi$ is the phase difference of the third component with respect to the first component, and D' is a value satisfying the relationship $d(\theta)=D$ at an angular position at which $d(\theta)$ reaches a maximum value.

The inventors have calculated the ratio of the amplitude $\Delta T$ of the overall torque fluctuation with respect to the average overall drive torque $\overline{T}$ for various values of the constants $k_1$ and $\psi$ appearing in equation (15), the drive torque being calculated assuming the compressor to be operated at the compression ratio $\epsilon=6$. The results are plotted in the graph of FIG. 7.

Figure 7:
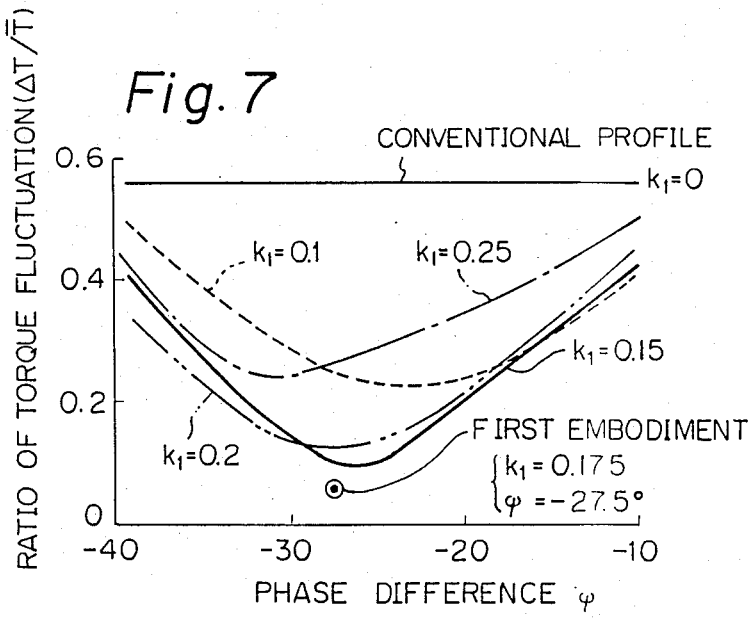
FIG. 7 is a graph showing the relationship between the torque fluctuation and the phase difference for different values of $k_1$.

From the graph of FIG. 7, it will be noted that, although the optimum value of the phase difference $\psi$ varies for different values of the ratio of amplitude $k_1$, the fluctuation of the overall drive torque will be reduced to about one half of the fluctuation generated by the conventional cylinder bore profile, if the ratio of amplitude $k_1$ is greater than 0.1 and less than 0.25 ($0.1<k_1<0.25$) and if the phase difference $\psi$ is in the range of from −35° to −20° ($-35°<\psi<-20°$).

According to our calculation, the optimal fluctuation reduction is resulted when $k_1=0.175$ and $\psi=-27.5°$ as shown by the dotted circle in FIG. 7. Thus, the cylinder bore profile according to the preferred embodiment shown in FIG. 3 is designed so that the amount of vane projection varies along the following equation:

$$d(\theta)=0.452D\{\cos\theta+0.175\cdot\cos 3(\theta-27.5°)\}+D/2 \qquad (16)$$

Equation (16) corresponds to equation (2). In the preferred profile expressed by equation (16), the amount of vane projection reaches the maximum when the vane angle $\theta=16.7°$. The amount of projection becomes zero at the vane angle of $\theta=196.7°$ so that the moving radius of the vane becomes equal to the radius of the rotor.

Figure 8:
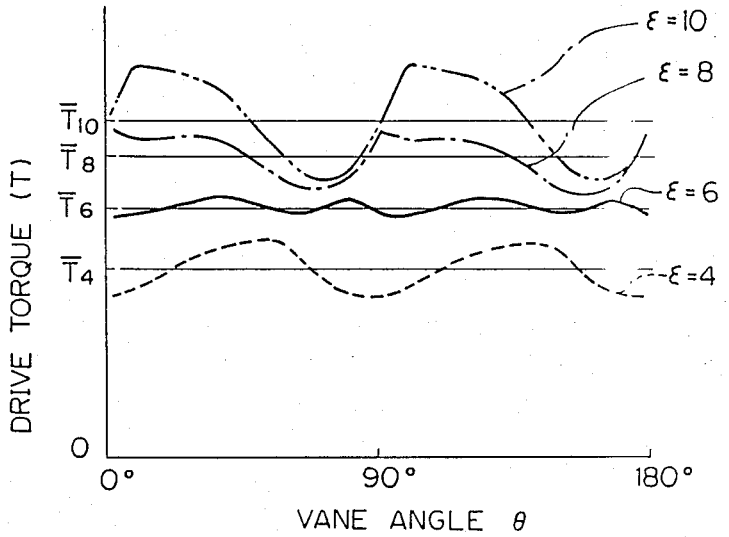
FIG. 8 is a graph showing the fluctuations of the overall torque for different compression ratios of the compressor.
Figure 9:
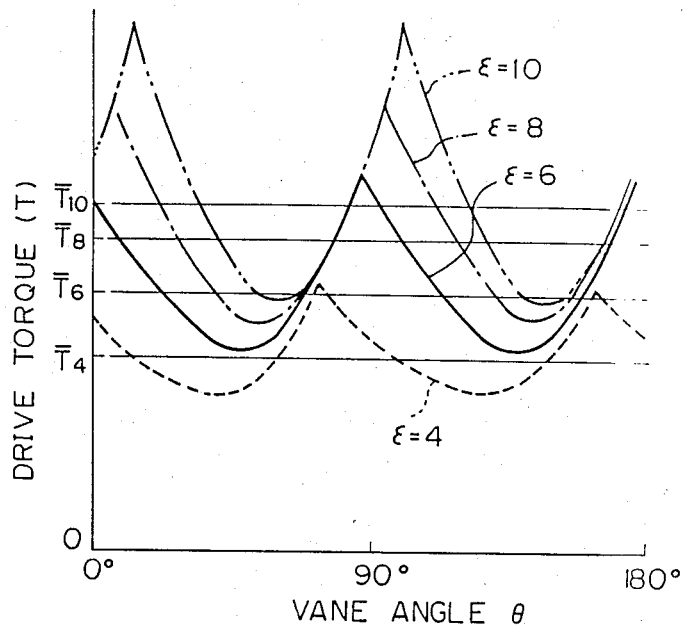
FIG. 9 is a graph similar to FIG. 8, but showing the overall torque fluctuation in the conventional vane compressor.

The inventors have calculated the fluctuation of the overall drive torque that is applied to the vane compressor having the cylinder bore profile according to the invention, the drive torque being calculated for various values of the compression ratio $\epsilon$. The results are plotted in the graph of FIG. 8. The overall torque fluctuation is similarly calculated for a compressor having the conventional bore profile and the results are given in the graph of FIG. 9. It will be observed that, with the cylinder bore profile according to the invention, the drive torque fluctuation becomes minimum when the compression ratio is set for 6. When the compression ratio is set for 4, 8, or 10, thereby deviating from 6, the torque fluctuation becomes greater. However, by comparing FIG. 8 with FIG. 9, it will be noted that the torque fluctuation developed by the bore profile according to the invention is much smaller than that of the conventional profile.

Figure 10:
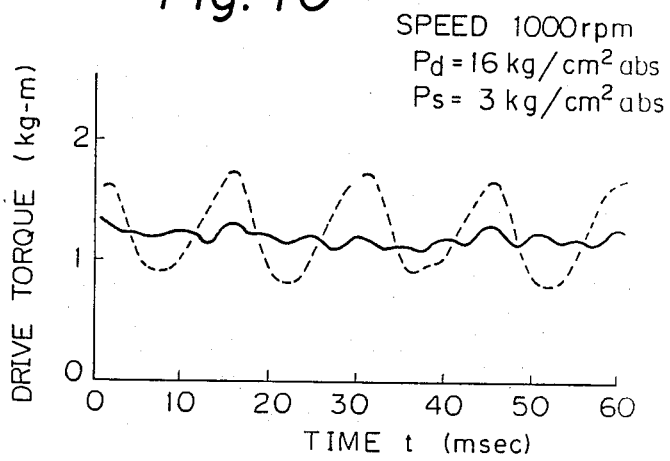
FIG. 10 is a graph showing the overall torque fluctuation in a compressor having a practical cylinder bore profile according to the invention.

In FIG. 10 there is shown by the solid line the fluctuation of the overall torque experienced when the vane compressor having the cylinder bore profile according to the invention is incorporated in a refrigerating system. The torque fluctuation occurring in a compressor having the conventional bore profile is shown therein by the broken line. It will be observed that, according to the bore profile of the invention, the overall torque fluctuation is remarkably reduced.

It should be noted that, in the foregoing embodiment, the centrally directed acceleration applied to each vane during operation of the compressor is limited because the cylinder bore profile is formed by composing the waves of lower degree such as a wave of the first degree and a wave of the third degree. It should also be noted that the illustrated embodiment is of the through-vane type in which the opposite ends of the vane assembly are positively held in contact with the inner wall of the cylinder bore. These features, in combination, serve to prevent the sealing edges of the vanes from jumping away from the inner wall of the cylinder bore, thereby avoiding the release of compressed fluid that would otherwise occur from the high pressure side to the low pressure side and eliminating the problem of chattering that would be generated due to vane jumping. Thus, it is possible to obtain a vane-type rotary compressor of high performance.

The practical cylinder bore profile according to the second embodiment of the invention will be described referring to FIGS. 11 and 12.

Figure 11:
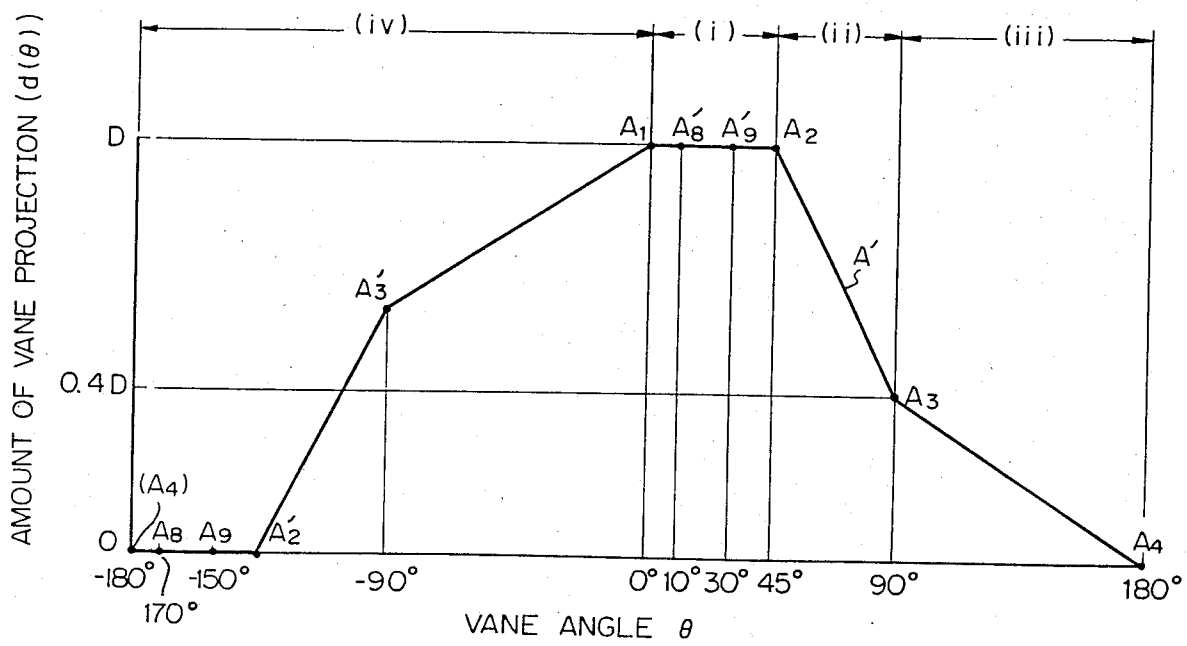
FIG. 11 is a graph similar to FIG. 5, but showing the theoretical bore profile according to another preferred embodiment of the invention.

In FIG. 11, the theoretical profile A′ illustrated in FIG. 5 is reproduced. As shown, this theoretical profile A′ includes two portions in which the amount of vane projection is held constant. One is the first region (i) spanning from the point $A_1$ to the point $A_2$. The other is the sealing region which extends from the point $A_4$ to the point $A_2'$ the inner wall of the cylinder bore is concentric with the axis of rotation of the rotor and closely approaches the outer periphery of the rotor to prevent leakage or blow-by of the high pressure fluid. In each of these portions $A_1$–$A_2$ and $A_4$–$A_2'$, the cylinder bore profile is in the form of an arc of a circle having its center at the axis of rotation of the rotor so that the vane undergoes no projecting or retracting movement in these portions. Therefore, the wider the range of these arc-like portions, the more intense the rate of change in the amount of vane projection in the remainder of the cylinder bore profile portion. In the theoretical profile A′ reproduced in FIG. 11, these arc-like portions $A_1$–$A_2$ and $A_4$–$A_2'$ extend, respectively, through a range of angle of 45°. Thus, in order to provide a smoother operation of the compressor, it is desirable to reduce the range of these arc-like portions without impairing the effect of reduction of overall torque fluctuation.

Therefore, in the practical cylinder bore profile according to the second embodiment of the invention, the extent of these arc-like portions is limited to less than the range of 45°. That is, in the fourth region (iv) between the points $A_4$ and $A_2'$, the arc-like portion is provided only between a point $A_8$ located at the vane angle of −170° and a point $A_9$ located at the vane angle of −150°, the arc-like portion extending through an angle of only 20°. Complementary to this, in the first region (i) between the points $A_1$ and $A_2$, an arc-like portion is formed for angle of 20° between a point $A_8'$ located at the vane angle of 10° and a point $A_9'$ located at the vane angle of 30°.

Figure 12:
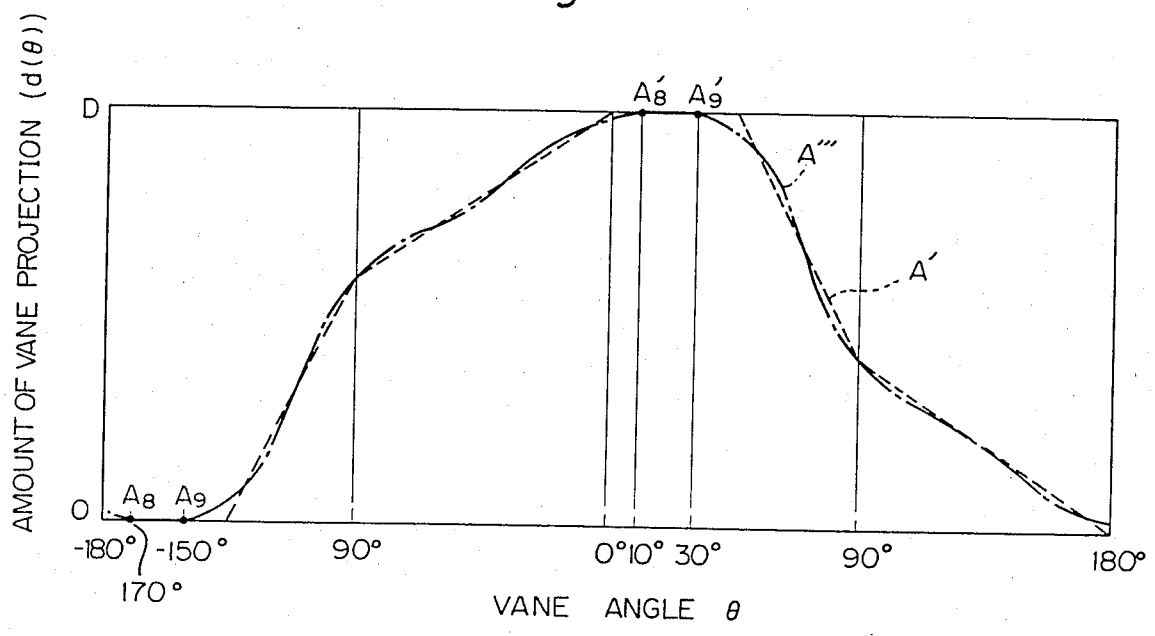
FIG. 12 is a graph showing a practical cylinder bore profile closely approximating the theoretical profile shown in FIG. 11.

FIG. 12 shows by the solid line the practical bore profile A‴ according to the second embodiment. The theoretical profile A′ is shown again by the broken line. The profile A‴ includes arc-like portions $A_8$–$A_9$ and $A_8'$–$A_9'$ in which the amount of vane projection is kept constant. The remaining profile portions located, respectively, between the points $A_9'$ and $A_8$ and between the points $A_9$ and $A_8'$ consist of smooth curves approximating the group of segments $\overline{A_9'A_2}$, $\overline{A_2A_3}$, $\overline{A_3A_4}$, and $\overline{A_4A_8}$ and the group of segments $\overline{A_9A_2'}$, $\overline{A_2'A_3'}$, $\overline{A_3'A_1}$, and $\overline{A_1A_8'}$, respectively. These smoothly curved profile portions may be formed of a wave composed of a fundamental wave expressed by equation (1) and of five other waves consisting, respectively, of the first through fifth components obtained by Fourier expansion of the fundamental wave.

Accordingly, the bore profile portion between the vane angles 30° and 180° may be determined so that the amount of vane projection d(θ) is expressed by the polynomial equation:

$$d(\theta) = D \cdot \left[ 1 - \frac{1}{160} \cdot (\theta - 30) + \sum_{n=1}^{5} \left( a_n \cdot \sin\left\{ (\theta - 30) \cdot \frac{\pi}{180} \cdot \frac{18}{16} \cdot n \right\} \right) \right] \quad (17)$$

where $a_1 = -0.169$, $a_2 = 0.023$, $a_3 = 0.041$, $a_4 = 0.05$, $a_5 = 0.017$, D is the maximum amount of vane projection, and $\pi$ is the ratio of the circumference of a circle to its diameter.

The bore profile portion between the vane angles −180° and −170° is designed so that the amount of vane projection d(θ) is expressed by the polynomial equation $$d(\theta) = D \cdot \left[ 1 - \frac{1}{160} (\theta + 330) + \sum_{n=1}^{5} \left( a_n \cdot \sin\left\{ (\theta + 330) \cdot \frac{\pi}{180} \cdot \frac{18}{16} \cdot n \right\} \right) \right] \quad (18)$$

In the through-vane type compressor, the bore profile portion between the vane angles −150° and 10° is complementary to the bore profile portion between the vane angles 30° and −170° and thus the amount of vane projection in this portion is expressed by the following polynomial equation:

$$d(\theta) = D - D \cdot \left[ 1 - \frac{1}{160} (\theta + 150) + \sum_{n=1}^{5} \left( a_n \cdot \sin\left\{ (\theta + 150) \cdot \frac{\pi}{180} \cdot \frac{18}{16} \cdot n \right\} \right) \right] \quad (19)$$

Figure 13:
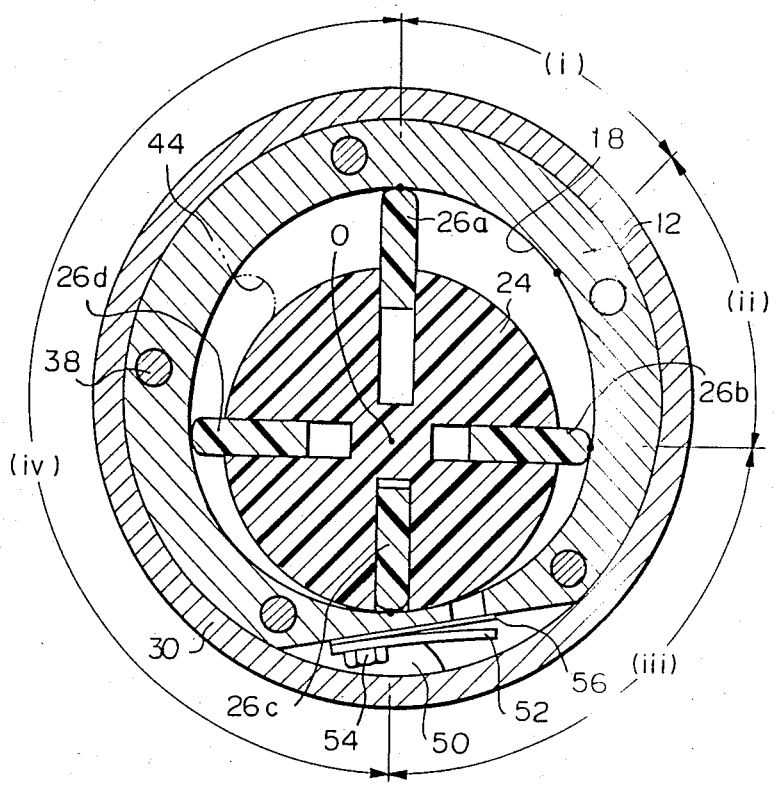
FIG. 13 is a cross-sectional view similar to FIG. 2, but showing the cylinder bore profile according to the invention as applied to a rotary compressor having four independent vanes.

(6) Application of Cylinder Bore Profile to Independent-Vane Type Compressor FIG. 13 shows the cylinder bore profile according to the invention as applied to an independent-vane-type or non-through-vane type compressor. Parts and members similar to those shown in FIG. 2 are indicated by like reference characters and will not be described again.

In the embodiment illustrated in FIG. 2, the compressor is described and illustrated as being of the through-vane type in which a pair of vane assemblies pass through the axis of rotation of the rotor and each vane assembly is provided with a pair of opposite sealing edges in sliding contact with the inner wall of the cylinder bore. The cylinder bore profile has been described as being accommodated to minimize the overall torque fluctuation at the compression ratio of 6.

In the embodiment shown in FIG. 13, the compressor is provided with four independent vanes 26*a* through 26*d*, each received slidably within respective vane slots. Each vane is adapted to be projected radially outward under the action of centrifugal force in combination, where appropriate, with the action of the delivery pressure applied to the inner end of the vane.

In this embodiment again, the profile of the cylinder bore 18 includes a first, second, and third regions (i), (ii), and (iii) identical to those described with reference to FIG. 3. However, in the independent-vane type or non-through-vane type compressor illustrated in FIG. 13, the bore profile portion in the fourth region (iv) need not be configured complementary to the profile portions of the first through third regions (i) through (iii). Thus, the profile portion in the fourth region (iv) may advantageously be designed so that the amount of vane projection or the moving radius increases at a constant rate.

While the present invention has been described herein with reference to the specific embodiments thereof, it should be understood that the present invention is not limited thereby but various changes and modifications may be made therein without departing from the scope of the invention.

For example, in the foregoing embodiments, the cylinder bore profile has been described as being designed so that the optimum fluctuation reduction is obtained when the compression ratio $\epsilon$ is set for 6. This is because it was thought that such a compression ratio is most desirable when the compressor is intended for use in a car air-conditioning system. However, the present invention is not limited to the vane-type rotary compressor operating with the compression ratio of 6.

Furthermore, the practical cylinder bore profile has been described herein in terms of the amount of vane projection or in terms of the moving radius expressed in specific equations comprising the first through fifth components of wave obtained by Fourier expansion. However, in order to make the practical cylinder bore profile approach the theoretical profile, various other methods of approximation may be readily understood for those skilled in the art. Thus, it should be noted that the bore profile of the present invention is not limited to the illustrated equations. Moreover, the angular extent and position of the profile region in which the amount of vane projection is constant are not limited to those of the foregoing embodiments.

Similarly, in the illustrated embodiments, the cylinder bore profile has been determined with the value of the adiabatic exponent k to be 1.14 on the assumption that the compressor is intended to pump the refrigerant R-12 used in a car air-conditioning system. However, in the case where the compressor is used as an air compressor, the value of the adiabatic exponent may be 1.4 and the compression ratio may be varied according to the operational conditions.

We claim:

1. In a sliding-vane rotary compressor including a vaned rotor and a pump cylinder having a cylinder bore, said compressor comprising four slidable vanes spaced apart from each other at an equal angular distance, said compressor having a single pumping chamber defined by said rotor and said pump cylinder, said vanes engaging the wall of said cylinder bore during rotation of said rotor to form cycles of intake, compression and delivery strokes for said vanes, the improvements wherein said cylinder bore has such a profile that the individual torque applied to an individual vane during each cycle of compression and delivery strokes of said vane varies along a torque curve which approximates an isosceles triangle, the lower side of which corresponds to a range of rotational angle of approximately 180°.

2. The improvement according to claim 1, wherein said bore profile comprises the following regions in sequence in the rotational direction of the rotor for a section located between an imaginary point ($A_1$) at which the vane angle $\theta$ is equal to zero ($\theta=0$) and an imaginary point ($A_4$) at which the vane angle $\theta$ is equal to 180°($\theta=180°$), the vane angle $\theta$ being measured in the direction of the rotation of the rotor with respect to the angular position of the vane at which the amount of projection of vane from the rotor reaches a maximum value (D), (i) a first region in which the amount of vane projection is held substantially constantly at the maximum value (D), (ii) a second region in which the amount of vane projection decreases substantially at a first rate, and (iii) a third region in which the amount of vane projection decreases to zero substantially at a second rate smaller than said first rate, the imaginary transitional point ($A_3$) between said second and third regions (ii) and (iii) being located substantially at an angular position of $\theta=90°$.

3. The improvement according to claim 2, wherein said profile regions (i), (ii), and (iii) extend, respectively, through an angle of about 45°, 45°, and 90° and wherein the amount of vane projection at said transitional point ($A_3$) is equal to about 40% of said maximum value (D).

4. The improvement according to claim 3, wherein said cylinder profile is approximately defined by a smooth continuous curve expressed by the equation $$d(\theta)=(D'/2)\{\cos\theta+k_1\cdot\cos 3(\theta+\psi)\}+D/2$$

where $d(\theta)$ is the amount of vane projection at a vane angle $\theta$, D is the maximum amount of vane projection, $k_1$ is a constant greater than 0.1 and less than 0.25 ($0.1<k_1<0.25$), $\psi$ is a constant greater than $-35°$ and less than $-20°$ ($-35°<\psi<-20°$), and D' is a value satisfying the relationship $d(\theta)=D$ at an angular position at which $d(\theta)$ reaches maximum value.

5. The improvement according to claim 2, wherein said cylinder profile is approximately defined by a smooth continuous curve expressed by the following equations:

for vane angle $10° \leqq \theta \leqq 30°$, $d(\theta) = D$;
for vane angle $30° \leqq \theta \leqq 180°$, -continued $$d(\theta) = D \cdot \left[ 1 - \frac{1}{160} \cdot (\theta - 30) + \sum_{n=1}^{5} \left( a_n \cdot \sin\left\{ (\theta - 30) \cdot \frac{\pi}{180} \cdot \frac{18}{16} \cdot n \right\} \right) \right];$$

for vane angle $-180° \leqq \theta \leqq -170°$, $$d(\theta) = D \cdot \left[ 1 - \frac{1}{160} (\theta + 330) + \sum_{n=1}^{5} \left( a_n \cdot \sin\left\{ (\theta + 330) \cdot \frac{\pi}{180} \cdot \frac{18}{16} \cdot n \right\} \right) \right];$$

for vane angle $-170° \leqq \theta \leqq -150°$, $d(\theta) = 0$; and
for vane angle $-150° \leqq \theta \leqq 10°$, -continued $$d(\theta) = D - D \cdot \left[ 1 - \frac{1}{160} \cdot (\theta + 150) + \sum_{n=1}^{5} \left( a_n \cdot \sin\left\{ (\theta + 150) \cdot \frac{\pi}{180} \cdot \frac{18}{16} \cdot n \right\} \right) \right]$$

where $a_1 = -0.169$,
$a_2 = 0.023$,
$a_3 = 0.041$,
$a_4 = 0.05$,
$a_5 = 0.017$,
$d(\theta)$ is the amount of vane projection at a vane angle $\theta$,
D is the maximum amount of vane projection, and
$\pi$ is the ratio of the circumference of a circle to its diameter.

* * * * *